US006098693A

United States Patent [19]

Frey, Jr.

[11] Patent Number: 6,098,693

[45] Date of Patent: Aug. 8, 2000

[54] TRAVEL LATCH FOR RETRACTABLE AWNING

[75] Inventor: Sydney W. Frey, Jr., Brookfield, Wis.

[73] Assignee: White Consolidated Industries, Inc., Cleveland, Ohio

[21] Appl. No.: 09/274,847

[22] Filed: Mar. 23, 1999

[51] Int. Cl.[7] ..... E04F 10/06

[52] U.S. Cl. ..... 160/67; 160/71; 160/72; 135/88.18; 248/286.1; 292/107

[58] Field of Search ..... 160/67, 71, 72, 160/68, 80, 301; 135/88.1, 88.18; 248/286.1, 276.1; 292/87, 89, 80, 81, 107

[56] References Cited

U.S. PATENT DOCUMENTS

| | | | |
|---|---|---|---|
| 3,789,903 | 2/1974 | Clark et al. . | |
| 4,077,419 | 3/1978 | Lux . | |
| 4,117,876 | 10/1978 | Bennett . | |
| 4,658,877 | 4/1987 | Quinn . | |
| 4,719,954 | 1/1988 | Curtis et al. . | |
| 4,819,706 | 4/1989 | Quinn . | |
| 4,819,707 | 4/1989 | Watson et al. . | |
| 4,832,384 | 5/1989 | Venable | 292/87 |
| 5,094,285 | 3/1992 | Murray . | |
| 5,172,743 | 12/1992 | Wallace et al. . | |
| 5,292,169 | 3/1994 | O'Brian | 160/67 X |
| 5,472,007 | 12/1995 | Malott . | |
| 5,752,556 | 5/1998 | Steadman | 160/71 X |
| 5,896,908 | 4/1999 | Kaun | 160/67 |

*Primary Examiner*—Bruce A. Lev
*Attorney, Agent, or Firm*—Pearne & Gordon LLP

[57] ABSTRACT

A retractable awning for mounting to a wall such as the side of a recreational vehicle. The awning includes a roller, a flexible canopy having an inner edge connected to the wall and an outer edge secured to the roller, a pair of arm assemblies supporting opposite ends of the roller and operable to move the roller between a retracted position adjacent the wall and an extended position spaced from the wall, and a travel latch for securing the arm assemblies in the retracted position. Each of the arm assemblies includes a vertically extending base arm connected to the wall, a bottom arm having a first end pivotally connected to the base arm, an extended arm having a first end pivotally connected to the bottom arm and a second end connected to and supporting the roller, and a top arm having a first end pivotally connected to the base arm above the bottom arm and a second end pivotally connected to the extended arm. The base arm and the extended arm each have a main wall and a pair of side walls extending from opposite edges of the main wall to form a channel. The channels of the base and extended arms facing each other in the retracted position to form a storage cavity for the top and bottom arms. At least one of the side walls of the base arm has a lip for cooperating with the travel latch. The latch is comprised of a resilient polymer and is secured to one of the extended arms. The latch has an angled ramp which engages the lip to releasably secure the extended arm to the base arm with spring tension when the awning is in the retracted position.

28 Claims, 10 Drawing Sheets

FIG. 1
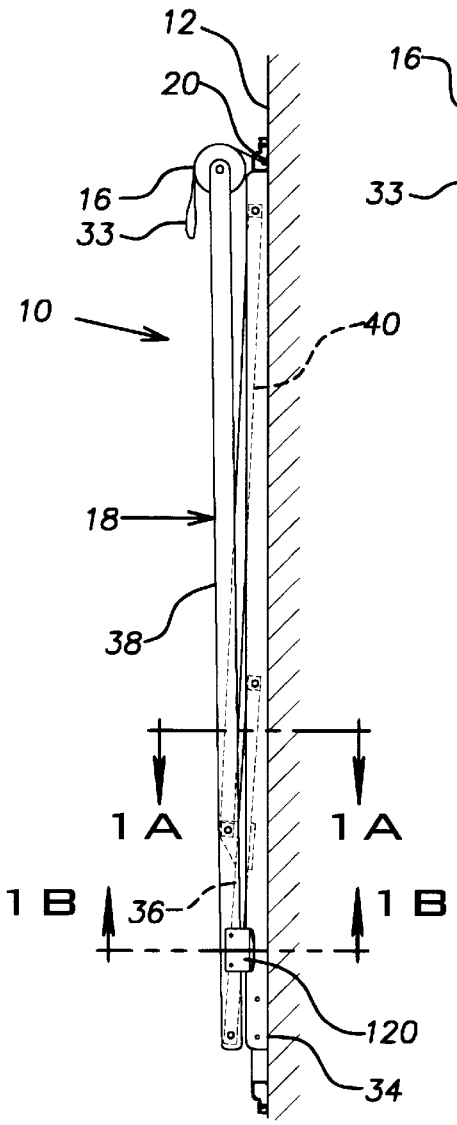
FIG. 2
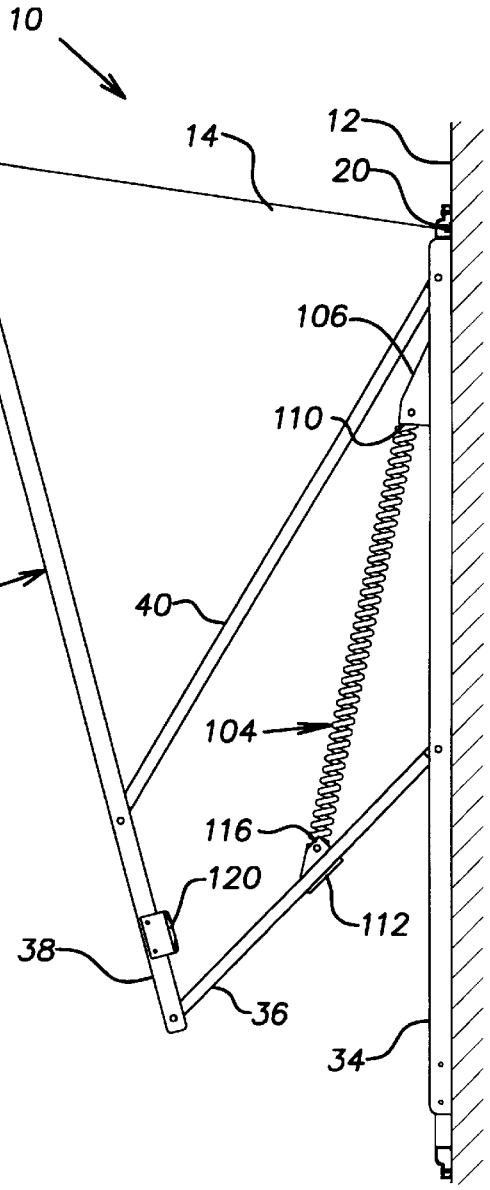
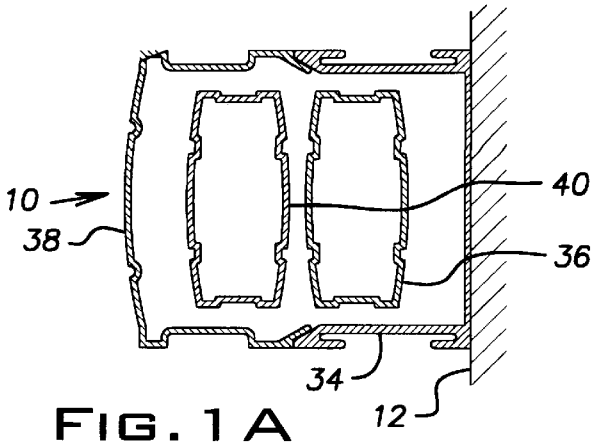
FIG. 1A

FIG. 4
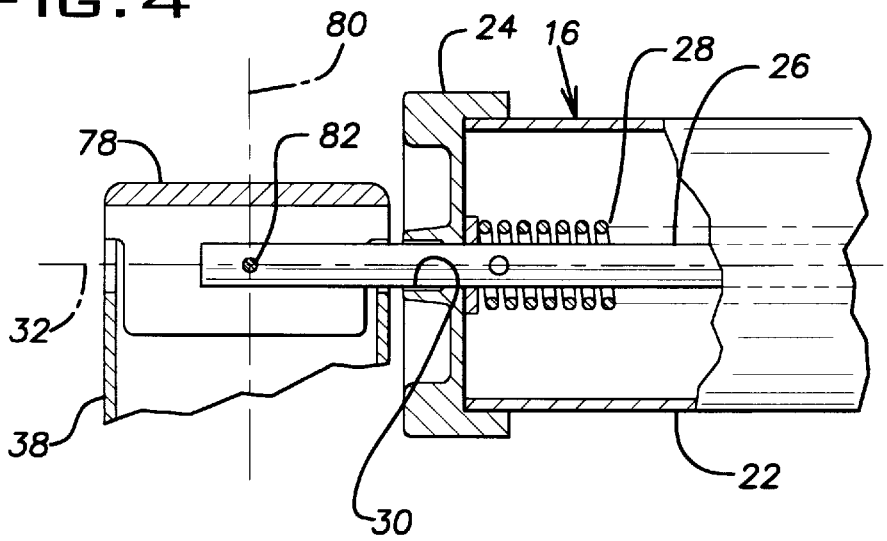
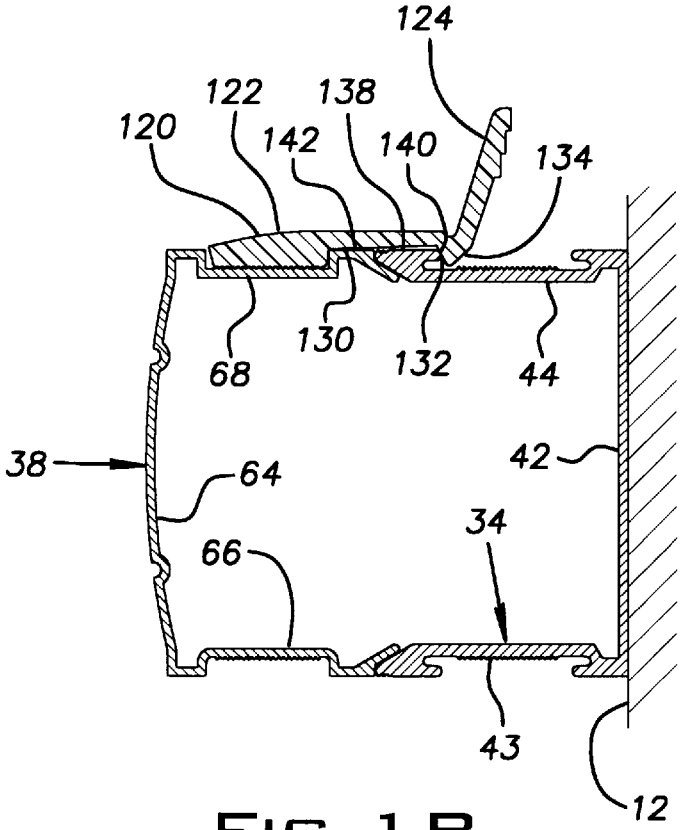
FIG. 1 B 104
114
112
106
108
64
66
68
69
38
86
90
120
18
40
70
56
36
112
114
104
54
118
34
44
42
116
49
84
46
48
88
106
110
58
43
45
47
52
51
50

40
100
88
96
84
100
96
102
98
86
98
102
90
70
76
74
74
56
76
36
62
58
60
54
60
62
64
68
66
69
38
94
120
72
18
47
52
50
49
42
44
45
34
50
59
118
46
43
92
112
108
110
104
116
114
112

FIG. 8
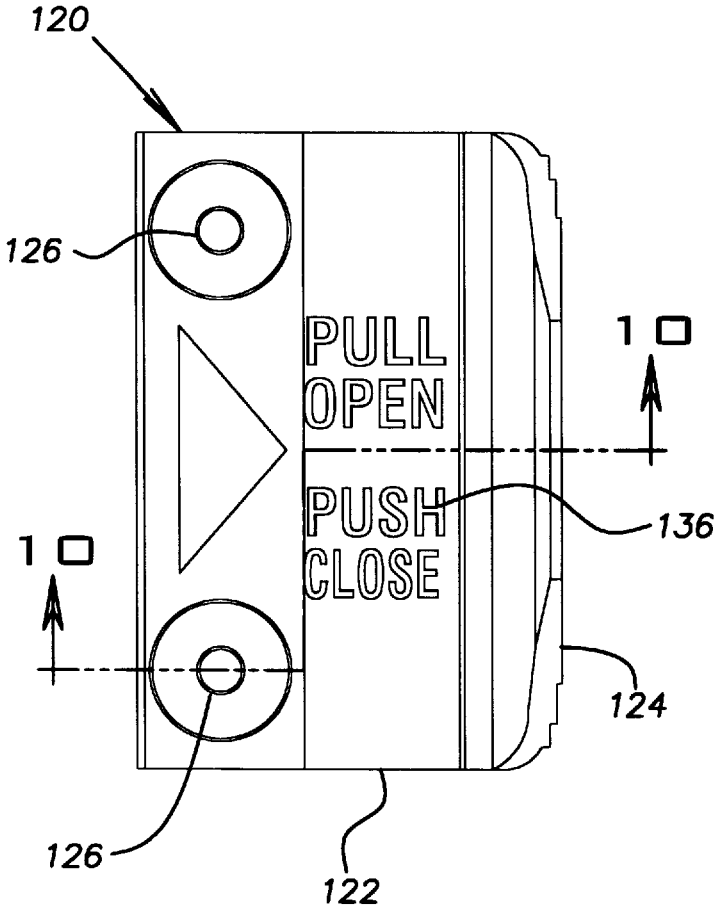
FIG. 9
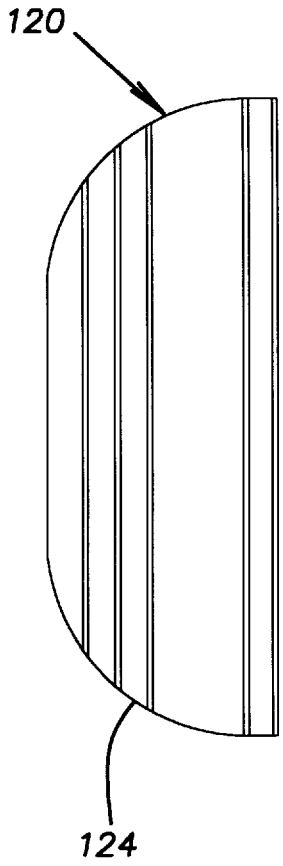
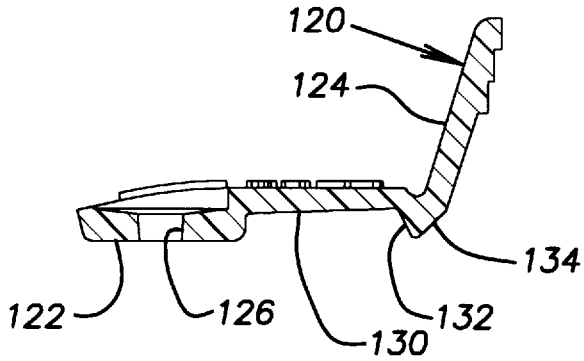
FIG. 10

TRAVEL LATCH FOR RETRACTABLE AWNING

BACKGROUND OF THE INVENTION

The present invention generally relates to retractable awnings of the type to be mounted to a substantially vertical support surface and, more specifically, to such awnings which have a latch for releasably securing the awning in a retracted position adjacent the support surface.

There are a number of known retractable awnings that support an awning or canopy to create a sheltered area. An inner end of the canopy is typically secured to a wall and an outer end of the canopy is typically secured to a roller assembly. The roller assembly is supported at its ends by support arms for movement between a stored or retracted position, wherein the roller assembly is disposed adjacent the wall, and a deployed or extended position, wherein the roller assembly is extended out away from the wall. When the roller assembly is in the retracted position, the canopy is rolled-up on the roller assembly. When the roller assembly is in the extended position, the canopy is unrolled from the roller assembly and extends between the wall and the roller assembly. These retractable awnings are often designed for use with movable structures such as, for example, recreational vehicles, travel trailers, mobile homes, and the like, but are also usable with fixed structures such as, for example, buildings. Travel latches or locks have been employed which retain the awning in the stored position in order to safeguard against the awning accidentally deploying or extending while the structure is moving or while the structure is exposed to high winds.

U.S. Pat. No. 5,172,743 discloses a travel lock which has a generally cylindrical locking pin extending upwardly from a rafter arm. When the awning is in the retracted position, the pin extends through an opening in a support arm and into a lock keeper. The lock keeper is slidably mounted to the outside of the support arm. To lock the awning in the retracted position, the lock keeper must be moved downwardly to cause a notch in the lock keeper to engage a head of the pin.

U.S. Pat. No. 4,719,954 discloses a locking fork slidably mounted on the end of a support arm adjacent the roll bar and having a gear tooth. To lock the awning in the retracted position, the fork must be moved upwardly to engage the gear tooth with a gear attached to the end of the roll bar. Additionally, straps attached to rafter arms can be wrapped and tied around the rafter arms and associated support arms to further lock the awning in the retracted position. See also U.S. Pat. Nos. 4,077,419, 4,117,876, and 4,658,877 for similar locking mechanisms which engage the roll bar at the top of the support arm.

U.S. Pat. No. 5,094,285 discloses a support arm which folds into a rafter arm. The support arm is provided with a pin which longitudinally slides into a slot within the tension rafter when the support is shortened to prevent the support arm from pivoting away from the rafter arm. To lock the support arm in the shortened position and ensure that the support arm stays within the rafter arm, a clamping knob must be tightened.

U.S. Pat. No. 4,819,706 discloses a locking arm pivotally mounted to a support arm. When the awning is in the retracted position, the locking arm must be pivoted from a retracted position to a locking position. In the locking position, a flange on the locking arm obstructs part of the opening of the support arm channel to retain the rafter arm in the support arm channel. The locking arm is provided with a camming surface that, if the locking arm is placed in the locking position before the rafter arm is positioned within the support arm, automatically cams the locking arm away from the support arm channel.

U.S. Pat. No. 5,472,007 discloses a spring clip which is carried by a rafter arm and retains the rafter arm in an associated support arm when the rafter arm is nested in a channel of the support arm.

While these travel locks may perform their designed function, there is a never ending desire to have a more effective, easier to operate, and inexpensive travel lock. Accordingly, there is a need in the art for an improved travel lock for a retractable awning.

BRIEF SUMMARY OF THE INVENTION

The present invention provides a retractable awning which overcomes at least some of the above-noted problems of the related art. According to the present invention, the awning includes a roller, a flexible canopy having an inner edge for connection to a wall and an outer edge secured to the roller, a pair of arm assemblies supporting opposite ends of the roller and operable to move the roller between a retracted position adjacent the wall and an extended position spaced from the wall, and a latch for releasably securing the roller in the retracted position. Each arm assembly includes a vertically extending base arm for connection to the wall, a bottom arm having a first end pivotally connected to the base arm, an extended arm having a first end pivotally connected to the bottom arm and a second end connected to and supporting the roller, and a top arm having a first end pivotally connected to the base arm and a second end pivotally connected to the extended arm. The latch is secured to one of the extended arms and is adapted to engage the base arm to releasably secure the extended arm to the base arm using spring tension.

According to a preferred embodiment of the present invention, the latch is comprised of a resilient polymer and is rigidly secured to a side wall of the extended arm which is channel shaped. Preferably, the latch has an angled ramp adapted for engaging a lip on a side wall of the base arm which is channel shaped to releasably secure the extended arm to the base arm using spring tension created by deflection of both the latch and the associated side wall of the extended arm.

BRIEF DESCRIPTION OF THE SEVERAL VIEWS OF THE DRAWING

These and further features of the present invention will be apparent with reference to the following description and drawings, wherein:

FIG. 1 is a side elevational view of an awning according to the present invention near a stored or retracted position;

FIG. 1A is an enlarged cross-sectional view taken along line 1A—1A of FIG. 1;

FIG. 1B is an enlarged cross-sectional view taken along line 1B—1B of FIG. 1;

FIG. 2 is a side elevational view of the awning of FIG. 1 in a partially deployed or extended position;

FIG. 4 is an enlarged and fragmented elevational view, partially in cross-section, showing the end of a roller assembly of the awning assembly of FIG. 1;

FIG. 8 is a front view of the travel latch of FIG. 7;

FIG. 9 is a side view of the travel latch of FIG. 8;

FIG. 10 is a cross-sectional view taken along line 10—10 of FIG. 8;

DETAILED DESCRIPTION OF PREFERRED EMBODIMENTS

Figures 3, 3A, 3B:
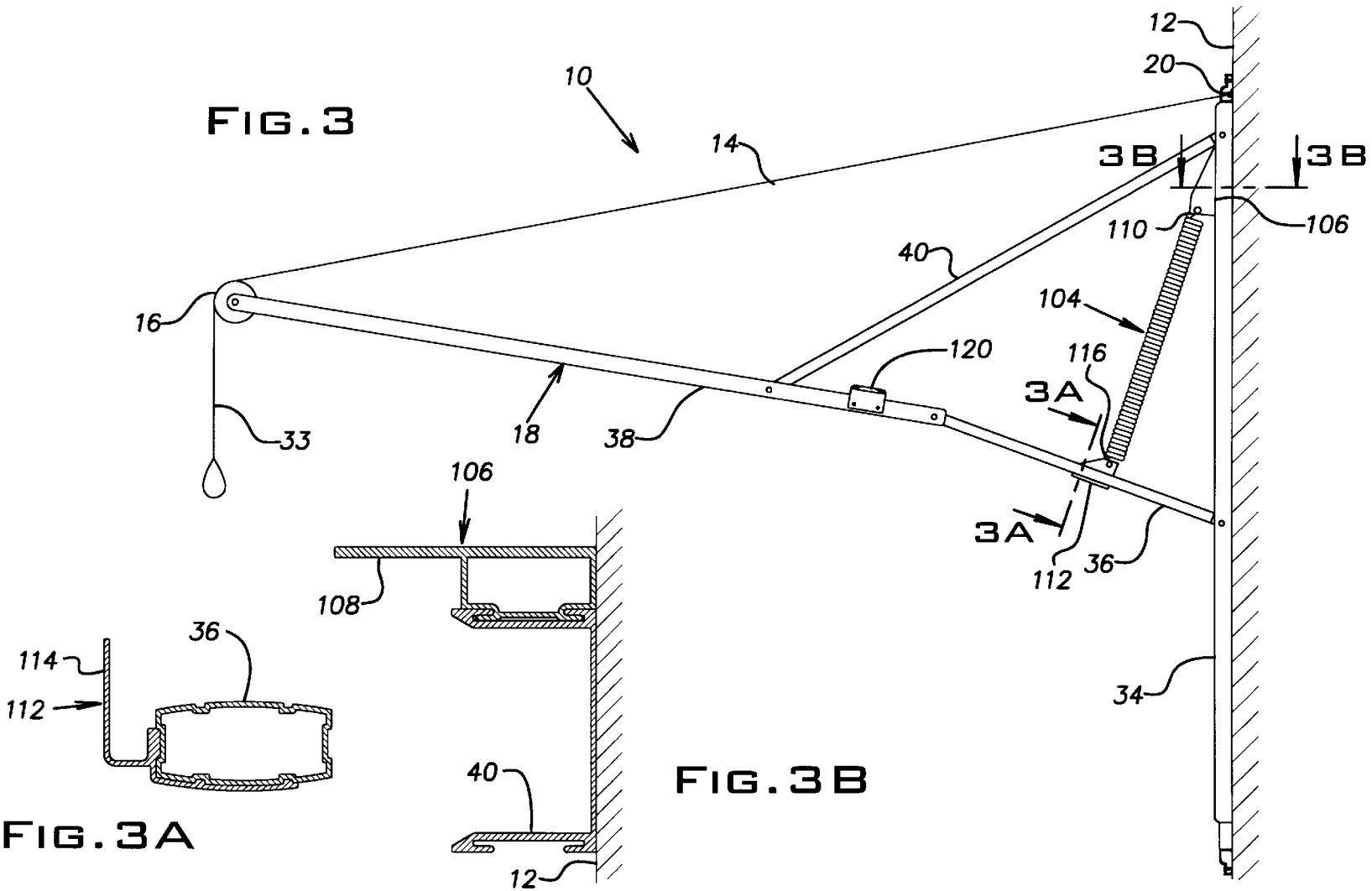
FIG. 3 is a side elevational view of the awning of FIGS. 1 and 2 in a fully deployed or extended position.
FIG. 3A is an enlarged cross-sectional view taken along line 3A—3A of FIG. 3.
FIG. 3B is an enlarged cross-sectional view taken along line 3B—3B of FIG. 3.

FIGS. 1 to 3 illustrate a first embodiment of a retractable awning 10 according to the present invention. The retractable awning 10 is attached to a vertically-extending support wall 12 such as a side of a recreational vehicle. The term "recreational vehicle", as used in the specification and claims, includes campers, travel trailers, mobile homes, vans, buses, and the like. While the awning 10 is particularly advantageous when attached to recreational vehicles, it can alternatively be attached to other vertically-extending walls such as, for example, the side of a building at a patio or deck or any other transportable or fixed structure.

The awning 10 is operable between a retracted or stored position (shown in FIG. 1) and an extended or sheltering position (shown in FIG. 3). In the retracted position, the awning 10 is in a compact configuration close to the side support wall 12 of the recreational vehicle so that the recreational vehicle can travel to desired destinations with minimum side projections (best shown in FIGS. 1 and 1A). After a destination is reached, the awning 10 is deployed from the retracted position to the extended position if a covered area is desired to protect against sun, rain, and the like.

The awning 10 includes an awning or canopy 14 for selectively covering an area adjacent to the wall 12, a roller assembly 16 for furling an unfurling the canopy 14, and right and left arm assemblies 18 for supporting opposite ends of the roller assembly 16.

The canopy 14 is a sheet of flexible material such as, for example, fabric, canvas, acrylic, or nylon and is preferably rectangularly shaped. The inner or top edge of the canopy 14 is secured to the support wall 12 and the outer or bottom edge of the canopy 14 is secured to the roller assembly 16. The inner and outer edges of the canopy 14 are preferably provided with an awning rope or other suitable cylindrical member. The awning rope is preferably a polypropylene rope and is preferably sewn in a hem or pocket formed at the edges of the canopy 14.

The rope at the inner edge of the canopy 14 is preferably held by an awning rail 20 which horizontally extends along the support wall 12 and is rigidly secured to the support wall 12 by suitable fasteners. The awning rail 20 is preferably an aluminum extrusion having a channel formed therein for retaining the awning rope in a known manner. It is noted that the inner edge of the canopy 14 can be alternately secured to the support wall 12 in other manners such as, for example, directly to the support wall 12 or to a cover attached to the wall 12. The awning rope at the outer edge of the canopy 14 is held by the roller assembly 16 as described in more detail hereinafter.

As best shown in FIG. 4, a suitable roller assembly 16 includes a roller tube 22, a pair of end caps 24 closing open ends of the roller tube 22, axles or bars 26 which rotatably support the roller tube 22, and at least one torsion spring 28. The roller tube 22 preferably has longitudinally extending channels or grooves formed therein so that the awning rope of the outer edge of the canopy 14 is secured to one of the grooves in a known manner.

Each end cap 24 is rigidly secured to the roller tube 22 for rotation therewith and has a central opening 30 therein. The bar 26 extends through the central opening 30 such that the roller tube 22 and the end cap 24 are free to rotate together with respect to the bar 26. The bars 26 form a rotational axis 32 for the roller tube 22 and support the roller tube 22. The torsion spring 28 is disposed around the bar 26 within the roller tube 22. The torsion spring 28 is operably connected between the roller tube 22 and the bar 26 in any known manner so that rotation of the roller tube 22 with respect to the bars 26 varies tension of the torsion spring 28. The torsion spring 28, therefore, can be advantageously preloaded for biasing the roller tube 22 to roll-up the canopy 14 onto the roller tube 22. Biased in this manner, the torsion spring 28 both tensions the canopy 14 when the awning 10 is held in the extended position and furls the canopy 14 onto the roller tube 22 when the awning 10 is moved from the extended position to the retracted position. It is noted that other configurations of roller assemblies and/or tensioning mechanisms can be utilized within the scope of the present invention.

The roller assembly 16 can also include a lock and release mechanism for selectively preventing rotation of the roller tube 22 in one direction or the other. The lock mechanism can be of any suitable type. See, for example, U.S. Pat. No. 5,732,756, disclosing a suitable lock mechanism for the roller assembly 16.

The roller assembly 16 also includes a pull strap 33. The pull strap 33 is preferably secured to one of the grooves of the roller tube 22 in a known manner. The pull strap 33 wraps around the roller tube 22 within the canopy 14 when the canopy 14 is rolled-up on the roller tube 22 so that a looped end slightly extends out of the canopy 14 when the canopy 14 is fully rolled-up onto the roller tube 22 (FIG. 1).

The bars 26 of the roller assembly 16 are supported by the arm assemblies 18. Each arm assembly 18 is disposed in a generally vertical plane at an associated side edge of the canopy 14 and an associated end of the roller assembly 16. The left and right arm assemblies 18 have essentially identical structures and therefore only one will be described in detail hereinafter.

Figures 5, 5A:
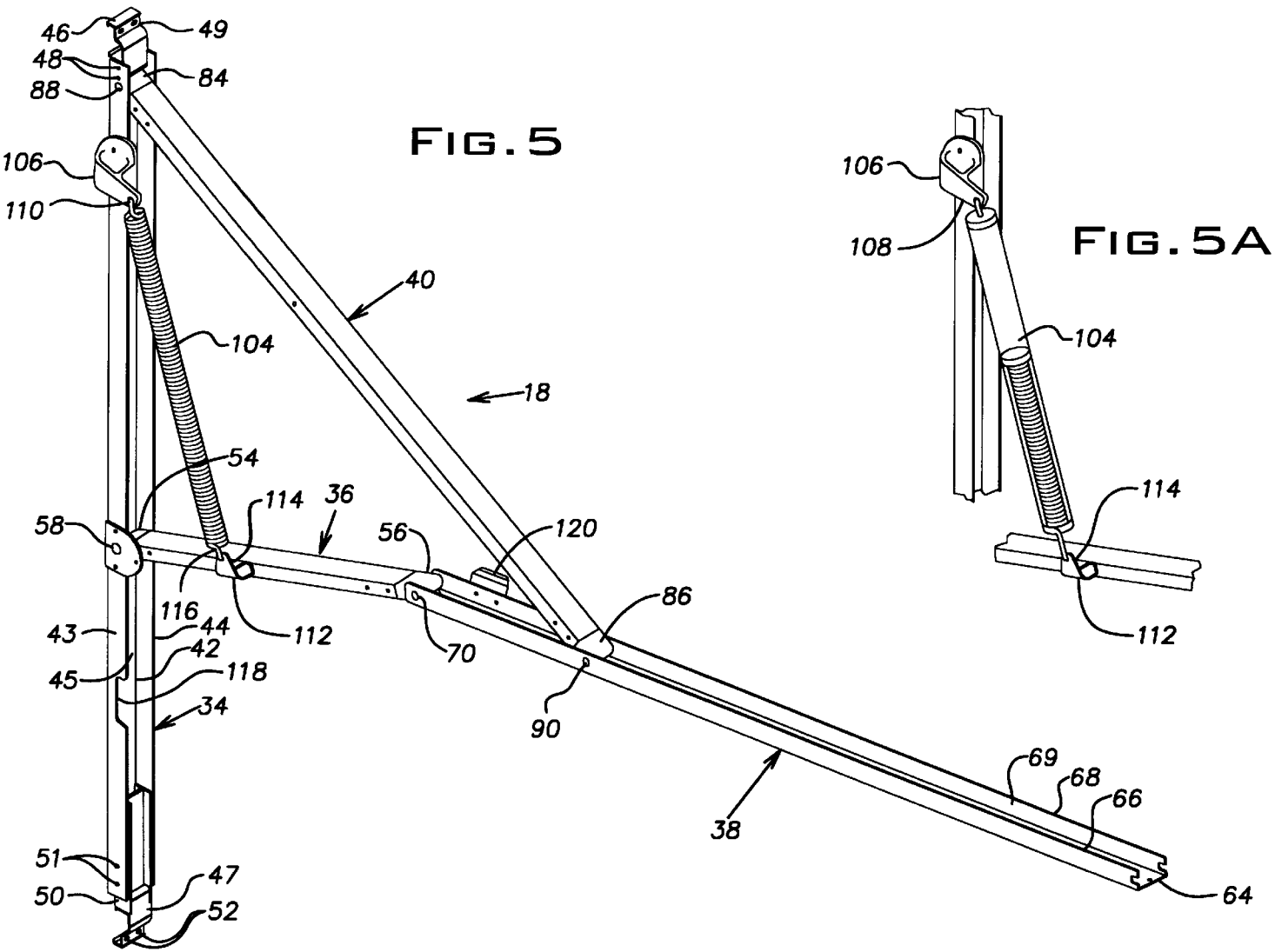
FIG. 5 is an enlarged perspective view of an arm assembly of the awning assembly of FIGS. 1 to 3 in the fully extended position.
FIG. 5A is a fragmented perspective view showing an alternative arrangement of a force producing member for assisting in the deployment of the awning.
Figure 6:
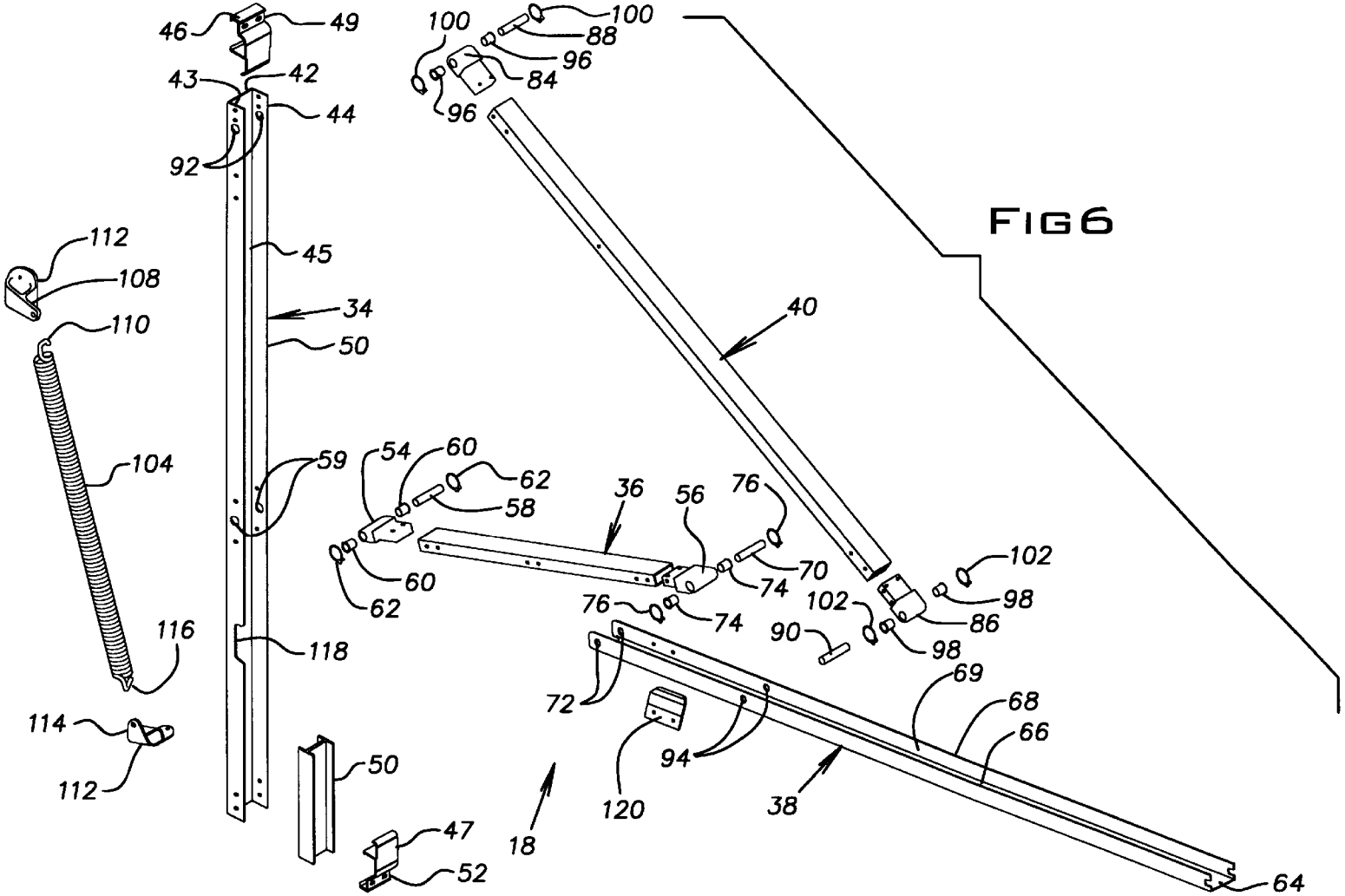
FIG. 6 is an exploded view of the arm assembly of FIG. 5.

As best shown in FIGS. 5 and 6, each arm assembly 18 is a four bar linkage including a first or base arm 34, a second or bottom arm 36, a third or extended arm 38, and a fourth or top arm 40. Each of the arms 34, 36, 38, 40 are substantially straight and elongate and are fixed in length. The arms 34, 36, 38, 40 are preferably extrusions of a light weight, high strength material such as an aluminum alloy.

The base arm 34 has a main wall 42 and inner and outer side walls 43, 44 which perpendicularly extend from opposed side edges of the main wall 42 to form a vertically extending and outward facing channel 45. The channel 45 is outward facing so that it at least partially receives the bottom and top arms 36, 40 when in the retracted position (see FIGS. 1 and 1A).

The base arm 34 is rigidly secured to the support wall 12, preferably with top and bottom mounting brackets 46, 47. The mounting brackets 46, 47 are preferably extrusions of a light weight, high strength material such as an aluminum alloy. The top mounting bracket 46 extends from the open upper end of the base arm 34. At the upper end of the base arm 34, the side walls 43, 44 are provided with openings for cooperating threaded fasteners 48 to rigidly attach the top mounting bracket 46 to the base arm 34. The top mounting bracket 46 has an inwardly extending top flange or hook member at an upper end thereof which can be advantageously located at a top rail of a recreational vehicle when the awning 10 mounted thereto. The top mounting bracket 46 is also provided with openings 49 below the top flange for cooperating with threaded fasteners to rigidly secure the top mounting bracket 46 to the support wall 12.

The lower end of the illustrated base arm 34 is provided with a base arm extension 50. The base arm extension 50 is sized to fit within the channel 45 of the base arm 34 so that it can longitudinally move therein in a telescoping manner. The base arm extension 50 cooperates with the base arm 34 so that the distance between the top and bottom mounting brackets 46, 47, which is the effective length of the base arm 34, is variable.

At the lower end of the base arm 34, the side walls 43, 44 are provided with openings for cooperating threaded fasteners 51 to rigidly attach the base arm extension 50 to the base arm 34. The side walls of the base arm extension 50 can be provided with a plurality of longitudinally spaced-apart openings so that the position of base arm extension 50 relative to the base arm 34 can be adjusted to a plurality of positions or can be custom drilled during installation, using the openings in the base arm side walls 43, 44 as pilots, once the base arm extension 50 has been located in its desired position relative to the base arm 34 so that there is infinite adjustability of the base arm extension 50.

The bottom mounting bracket 47 extends from the lower end of the base arm extension 50. The lower end of the base arm extension 50 is provided with openings for cooperating threaded fasteners to rigidly attach the bottom mounting bracket 47 to the base arm extension 50. The bottom mounting bracket 47 has an inwardly extending bottom flange or hook member at an lower end thereof which can be advantageously located at the box iron of a recreational vehicle when the awning 10 is mounted thereto. The bottom mounting bracket 47 is also provided with openings 52 for cooperating with threaded fasteners to rigidly secure the bottom mounting bracket 47 to the support wall 12.

As best shown in FIGS. 5 and 6, the bottom arm 36 has an inner end pivotally mounted to a central or intermediate portion of the base arm 34. The bottom arm 36 is preferably tubular in cross-section and is provided with inner and outer end caps or plugs 54, 56 secured to and closing the open inner and outer ends of the bottom arm 36 respectively. The end caps 54, 56 are secured to the bottom arm in any suitable manner such as, for example, rivets or screws. The inner end cap 54 is provided with an opening for receiving a pivot shaft 58 therethrough. The pivot shaft 58 extends through the inner end cap 54 and openings 59 in the side walls 43, 44 of the base arm 34 to form a pivot joint or rotatable connection therebetween. The pivot shaft 58 is preferably provided with suitable bearings 60, such as the illustrated flanged sleeve bearings, and is preferably held in position by retaining rings 62. The inner end cap 54 is optionally biased to a central position within the channel of the base arm 34 by spring washers located between the side walls 43, 44 of the base arm 34 and flanges of the bearings 60.

The extended arm 38 has an inner or lower end pivotally mounted to an outer or lower end of the bottom arm 36 and an outer or upper end connected to the end of the roller assembly 16 (best shown in FIG. 5). The extended arm 38 is preferably channel-shaped in cross-section having a main wall 64 and inner and outer side walls 66, 68 perpendicularly extending from opposed side edges of the main wall 64 to form a channel 69. The channel 69 preferably faces upward when the awning 10 is extended so that it at least partially receives the bottom arm 36 therein when in the retracted or stored position (see FIGS. 1 and 1A).

The outer end cap 56 of the bottom arm 36 is provided with an opening for receiving a pivot shaft 70 therethrough. The pivot shaft 70 extends through the outer end cap 56 and openings 72 in the side walls 66, 68 of the extended arm 38 to form a pivot joint or rotatable connection therebetween. The pivot shaft 70 is preferably provided with suitable bearings 74, such as the illustrated flanged sleeve bearings, and is preferably held in position by suitable retaining rings 76. The outer end cap 56 is optionally biased to a central position within the channel of the extended arm 38 by spring washers located between the side walls 66, 68 of the extended arm 38 and flanges of the bearings 74.

As best shown in FIG. 4, the upper or outer end of the extended arm 38 supports the roller assembly 16. The free end of the extended arm 38 is provided with an upper end cap 78 which has a socket into which the upper end of the extended arm 38 is closely received and rigidly secured. The upper end cap 78 is preferably secured to the extended arm 38 by rivets, but can be alternatively secured in other manners.

The upper end cap 78 and the roller assembly bar 26 are preferably secured together in a manner which allows rotation of the bar 26, relative to the upper end cap 78, about only one axis which facilitates handling and misalignment. The bar 26 cannot rotate about the rotational axis 32 or the longitudinal axis 80 of the extended arm 38. The bar 26, however, can rotate about a pivot axis which is substantially perpendicular to both the rotational axis 32 and the longitudinal axis 80 of the extended arm 38 at the outer or upper end of the extended arm 38. In the illustrated embodiment the pivot axis is formed by a pin 82 which extends through the bar 26 and the upper end cap 78. The bar 26 and the upper end cap 78, however, can be alternately joined in other suitable manners such as, for example, by a screw or tube rivet.

The top arm 40 has an inner or upper end pivotally mounted to an upper portion of the base arm 34 and an outer or lower end pivotally mounted to an intermediate portion of the extended arm 38 generally near the lower or inner end of the extended arm 38. The top arm 40 is preferably tubular in cross-section and preferably has inner and outer end caps or plugs 84, 86 secured to and closing the open inner and outer ends of the top arm respectively. The inner and outer end caps 84, 86 are each provided with an opening for receiving a pivot shaft 88, 90 therethrough. One pivot shaft 88 extends through the inner end cap 84 and openings 92 in the side walls 43, 44 of the base arm 34 to form a pivot joint or rotatable connection therebetween. The other pivot shaft 90 extends through the outer end cap 86 and openings 94 in the side walls 66, 68 of the extended arm 38 to form a pivot joint or rotatable connection therebetween. The pivot shafts 88, 90 are each preferably provided with suitable bearings 96, 98, such as the illustrated flanged sleeve bearings, and are preferably held in position by suitable retaining rings 100, 102. The inner end cap 84 is optionally biased to a central position within the channel of the base arm 34 by spring washers located between the side walls 43, 44 of the base arm 34 and flanges of the bearings 96. The outer end cap 86 is optionally biased to a central position within the channel of the extended arm 38 by spring washers located between the side walls 66, 68 of the extended arm 38 and flanges of the bearings 98.

It is this system of pivotally attached bars or arms 34, 36, 38, 40 which form a four-bar linkage that provides a support base which reaches out to support the roller assembly 16 and fold backs into a compact stack against the wall 12, by stacking the tubular-shaped arms 36, 40 within the channel-shaped arms 34, 38.

Each arm assembly 18 also includes a force producing member for assisting the outward pivoting the bottom arm 36 toward the extended position. In the illustrated embodiment, the force producing member is an assist spring 104. The illustrated assist spring is a tension coil spring but other suitable springs can be utilized such as, for example, a gas spring (see FIGS. 11–13) or a suitably configured assembly with a compression coil spring (see FIG. 5A) or a compression gas spring (see FIGS. 11–13).

The illustrated assist spring 104 is mounted between the base arm 34 and the bottom arm 36. A first end of the assist spring 104 is mounted to the base arm 34 by an upper mounting bracket 106. The upper mounting bracket 106 is secured to the side wall 43 of the base arm 34 at an upper portion thereof by any suitable manner such as, for example, rivets or screws. As best shown in FIG. 3B, the upper mounting bracket 106 is preferably an extrusion of a light weight, high strength material such as, for example, an aluminum alloy. The upper mounting bracket 106 is preferably shaped to interlock with the base arm 34 and to have an outwardly directed flange 108.

In the illustrated embodiment, the upper mounting bracket 106 is secured slightly below the pivot joint between the base arm 34 and the top arm 40. An end loop 110 of the assist spring 104 is pivotally connected to the flange 108 of the upper mounting bracket 106 in a suitable manner.

A second end of the assist spring 104 is mounted to the bottom arm 36 by a lower mounting bracket 112. As best shown in FIG. 3A, the lower mounting bracket 112 is preferably an extrusion of a light weight, high strength material such as, for example, an aluminum alloy. The lower mounting bracket 112 is preferably shaped to interlock with the bottom arm 36 and to have an outwardly directed flange 114.

The lower mounting bracket 112 is secured to the bottom arm 36 at a central or intermediate portion thereof by any suitable manner such as, for example, rivets or screws. The lower mounting bracket 112 is secured between the pivot joint between the base arm 34 and the bottom arm 36 and the pivot joint between the bottom arm 36 and the extended arm 38. An end loop 116 of the assist spring 104 is pivotally connected to the lower mounting bracket 112 a suitable manner. The side wall 43 of the base arm 34 is provided with a suitable cut-out or clearance opening 118 for the lower mounting bracket 112 when in the retracted position.

The assist spring 104 is positioned and sized to counterbalance the torsion spring 28 of the roller assembly 16 during deployment of the awning 10. There is a decrease in leverage of the roller assembly torsion spring 28 and an increase in leverage of the assist spring 104 as the extended arm 38 moves toward the extended position (best shown in FIG. 3) so that the operator receives increased assistance from the assist spring 104 when it is needed the most (near the end of deployment). As the awning 10 is extended, stored energy in the assist spring 104 assists deployment and is transferred to the torsion spring 28 of the roller assembly 16. Upon retraction, there is an increase in leverage of the roller assembly torsion spring 28 and an decrease in leverage of the spring 104 as the extended arm 38 moves toward the retracted position (best shown in FIG. 1) but the operator has good leverage in this location and does not need assistance from the assist spring 104. As the awning 10 is retracted, stored energy in the torsion spring 28 of the roller assembly 16 assists retraction and is transferred to the assist spring 104.

Figure 7:
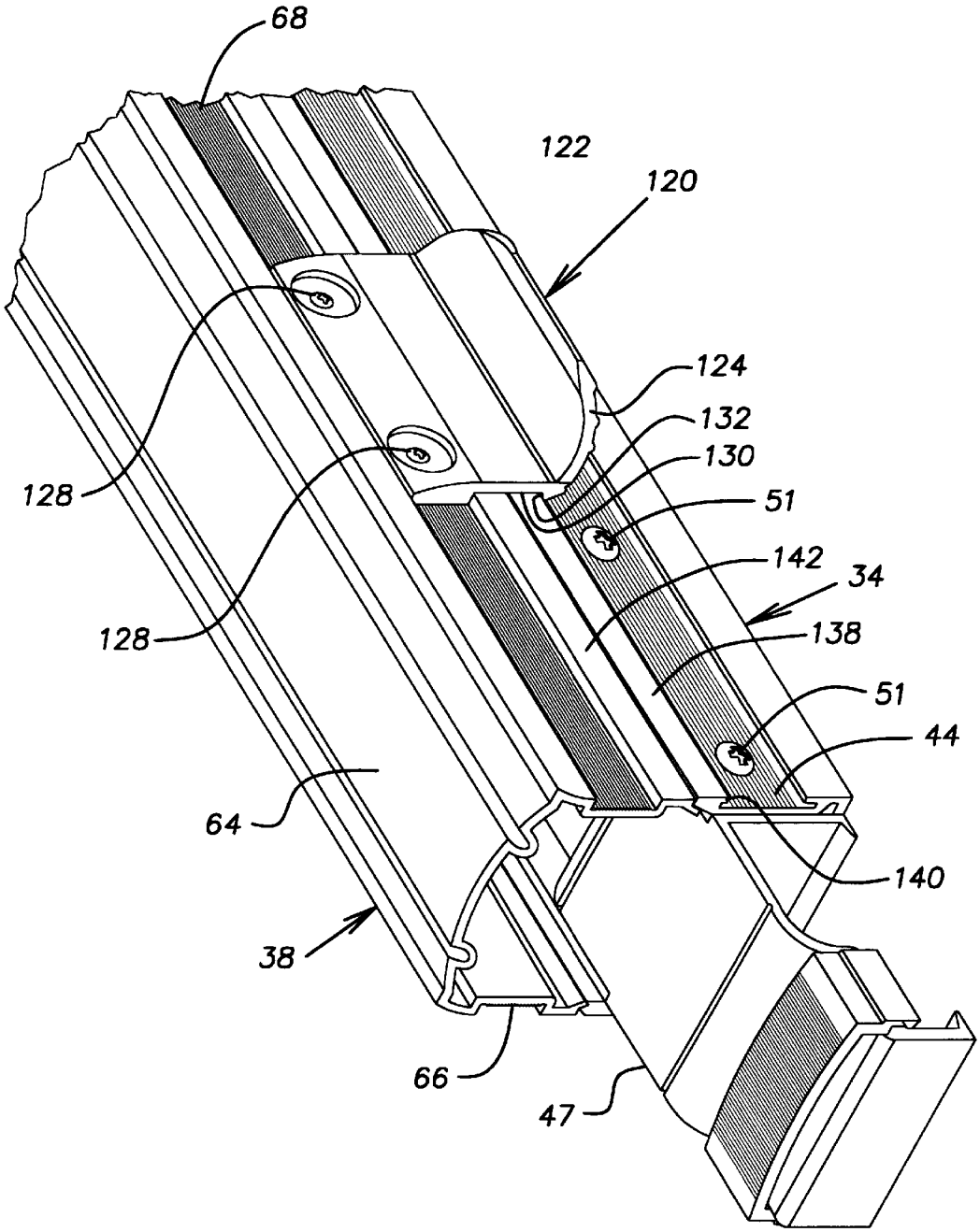
FIG. 7 is an enlarged and fragmented perspective view of the lower end of the awning assembly of FIG. 1 showing a travel latch.

As best shown in FIGS. 1B and 7, the awning 10 is provided with travel latches or locks 120 for retaining the arm assemblies 18 in the retracted position so that the awning 10 does not accidentally deploy while the recreational vehicle is traveling or when the recreational vehicle is exposed to high winds. Preferably there are two travel latches 120, each associated with a separate one of the arm assemblies 18. The travel latch 120 is preferably secured to the lower end of the extended arm 38 and is adapted to cooperate with the base arm 34 to secure the extended arm 38 to the base arm 34 when in the retracted position. It is noted that the travel latch 120 can alternatively be located at any location along the length of the extended arm.

The travel latch 120 is preferably an extrusion but alternatively can be molded or formed by any other suitable method. The travel latch 120 is preferably a plastic material having suitable elastic properties such as, for example, a nylon material. The material of the preferred embodiment is moly-filled nylon 6/6. It is noted, however, that other materials having suitable properties may be utilized such as, for example, spring steel or polyvinyl chloride (PVC).

As best shown in FIGS. 8–10, the travel latch 120 has a main wall 122 and a handle portion 124 angularly extending from a rear side of the main wall 122. The main wall 122 is provided with a pair of openings 126 near the forward side for receiving fasteners 128 (FIG. 7) to secure the travel latch 120 to the extended arm 38. The openings 126 are preferably provided with counterbores at the outer side of the main wall 122 for receiving heads of the fasteners 128 therein. The main wall 122 is also provided with a recess 130 near the rear side which extends the length of the main wall 122. The recess 130 is located on the inner side of the main wall 122, that is the side opposite the counter bores of the openings 126. The recess 130 forms a forward facing engagement ramp 132. The ramp 132 preferably forms an angle of about 15 to about 30 degrees and more preferably about 20 degrees relative to the main wall 122. The rear end of the main wail 122 is also preferably provided with an angled surface 134. The angled surface 134 preferably forms an angle of about 45 degrees relative to the main wall 122. The outer side of the main wall 122 is preferably provided with instructions or other suitable indicia 136 for communicating operating procedures of the travel latch 120 to the user.

As best shown in FIGS. 1B and 7, the recess 130 is sized and shaped to receive a longitudinally extending protrusion 138 on the outer surface of the base arm side wall 44. The protrusion 138 forms a rearward facing and longitudinally extending shoulder 140 which cooperates with the ramp 132 of the travel latch 120 to secure the extended arm 38 to the base arm 34 as described in more detail hereinafter. In the illustrated embodiment, the recess 130 also receives a longitudinally extending protrusion 142 located on the outer surface of the extended arm side wall 68 which is located adjacent the base arm protrusion 138 when the extended arm 38 is in the retracted position.

The travel latch 120 is rigidly secured to the extended arm 38 by the fasteners 128 extending through the openings 126 such that the main wall 122 rearwardly extends from the side wall 68 of the extended arm 38. In this position, the protrusion 142 of the extended arm 38 extends into a forward portion of the recess 130. Rearwardly extending in this manner, the travel latch 120 and the associated side wall 68 of the extended arm 38 cooperate to act as a leaf spring and which hold the ramp 132 laterally inward under spring tension but can be resiliently deflected outward by pulling the handle portion 124 to laterally move the ramp 132 outward. When the extended arm 38 is in the retracted position adjacent the base arm 34 and the travel latch 120 is in a locked position, the protrusion 138 of the base arm 34 is located within a rearward portion of the recess 130 and the ramp 132 and the shoulder 140 cooperate to prevent the extended arm 38 from forwardly moving away from the base arm 34. Note that the travel latch 120 does not have a hook-type member and relies on spring tension to secure the extended arm 38 to the base arm 34. The ramp 132 provides needed tolerances.

To unlock the travel latch 120 for deployment of the awning 10, the user manually pulls on the handle portion 124 in an outward direction to deflect the travel latch 120 and laterally move the travel latch ramp 132 free of the base arm shoulder 140 so that the extended arm 38 is free to move away from the base arm 34. To lock the travel latch 120 for retention of the awning 10, the user manually pushes the extended arm 38 in an inward direction against the base arm 34 and spring tension deflects the travel latch 120 to laterally move the travel latch ramp 132 into engagement with the base arm shoulder 140 so that the extended arm 38 is secured to the base arm 34.

When the awning 10 is the retracted position (best shown in FIGS. 1 and 1A), the bottom and top arms 36, 40 are stacked within the base and extended arms 34, 38 so that the awning 10 is in close relationship with the support wall 12 and the canopy 14 is fully rolled-up on the roller assembly 16. The base arm 34 and the extended arm 38 each have a substantially parallel relationship with the support wall 12 of the recreational vehicle. The bottom arm 36 and the top arm 40 are each located partially within the base arm 34 and partially within the extended arm 38. In this retracted position, the travel latch is locked to prevent movement of the arms 36, 38, 40 and to secure the arms 36, 38, 40 in their retracted positions.

To open the awning 10, the operator manually unlocks the roller assembly lock if provided to permit the canopy 14 to unroll from the roller assembly 16 and manually unlocks the travel latch 120 to permit the arms 36, 38, 40 to open. To unlock the travel latch 120, the operator manually pulls on the handle portion 124 of the travel latch 120 in an outward direction to deflect the travel latch 120 and laterally move the travel latch ramp 132 free of the base arm shoulder 140 so that the extended arm 38 is free to move away from the base arm 34. The travel latch 120 on the other arm assembly 18 is released in the same manner. It is noted that when the travel latches 120 are not snapped in place they act as an alignment device to prevent the pressure of the spring 104 from "kicking-out" the bottom of the extended arm 38 to mis-align the arms.

Once the travel latches 120 are unlocked, the operator grasps the awning pull strap 33 and pulls to move the roller assembly 16 away from the support wall 12 and unroll the canopy from the roller assembly 16. As best shown in FIG. 2, rotation of the bottom arm 36 and the resulting rotation of the top arm 40, downwardly rotates the extended arm 38 about its pivot joint with the bottom arm 36. As the top end of the extended arm 38 moves away from the wall 12, the canopy 14 is unrolled from the roller assembly 16. As the bottom arm 36 is upwardly rotated about its pivot joint with the base arm 34, the leverage of the assist spring 104 increases and assists deployment by supplying a force which counter-balances the torsion spring 28 of the roller assembly 16.

As best shown in FIG. 3, the assist spring 104 continues to decrease in length until the extended arm 38 is generally an extension of the bottom arm 36, that is, the extended arm 38 and the bottom arm 36 are generally coaxial. The assist spring 104 is then unloaded or nearly unloaded. In this position, the canopy 14 is fully extended and the awning 10 is in the deployed position. In this deployed position, the assist spring 104 pulls upwardly lightly on the bottom arm 36 and the roller assembly 16 is locked in place by the roller assembly lock to prevent the canopy 14 from rolling back onto the roller assembly 16. Suitable locks may also be provided to further secure the arms 36, 38, 40 in their deployed positions if desired.

To close the awning 10, the operator grasps the pull strap 133 and manually unlocks the roller assembly lock and any additional locks if provided to permit the canopy 14 to roll onto the roller assembly 16. The bias provided by the torsion spring 28 rolls the canopy 14 onto the roller assembly 16 and pulls the roller assembly 16 toward the support wall 12. As the roller assembly 16 moves toward the support wall 12, the bottom arm 36 is downwardly rotated about its pivot joint with the base arm 34 and the length of the spring 142 is increased to store energy therein for later deployment.

As best shown in FIG. 2, rotation of the bottom arm 36 and the resulting rotation of the top arm 40, upwardly rotates the extended arm 38 about its pivot joint with the bottom arm 36. As the top end of the extended arm 38 moves toward the support wall 12, the canopy 14 is rolled back onto the roller assembly 16.

As best shown in FIG. 1, the torsion spring 28 rotates the roller assembly 16 until the extended arm 38 is generally parallel with the base arm 34 and the support wall 12. In this position, the canopy 14 is fully furled up and the awning 10 is in the retracted position. It is noted that the travel latches 120 assist in aligning the extended arms 38 with the associated base arms 34 as the extended arms 38 approach the base arms 34. Without the travel latches 120, the extended arms 38 tend to be misaligned with the base arms 34 until they are manually adjusted. The operator then manually latches the travel latches 120 to prevent unwanted outward movement of the arms 36, 38, 40. To lock the travel latch 120, the operator manually pushes the extended arm 38 in an inward direction against the base arm 34 to deflect the travel latch 120 outwardly on shoulder 138. Spring tension, provided by defection of the side wall 68 and the travel latch 120, forces the travel latch ramp 132 to move laterally behind the base arm shoulder 140 so that the extended arm 38 is secured to the base arm 34. The travel latch 120 on the other arm assembly 18 is secured in the same manner.

Figure 11:
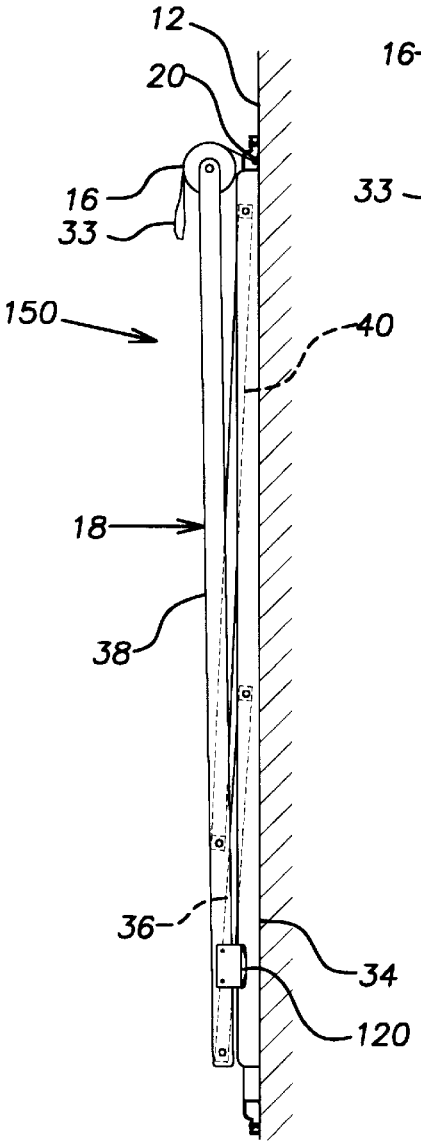
FIG. 11 is a side elevational view of another awning according to the present invention near a stored or retracted position and having a gas compression spring.
Figure 12:
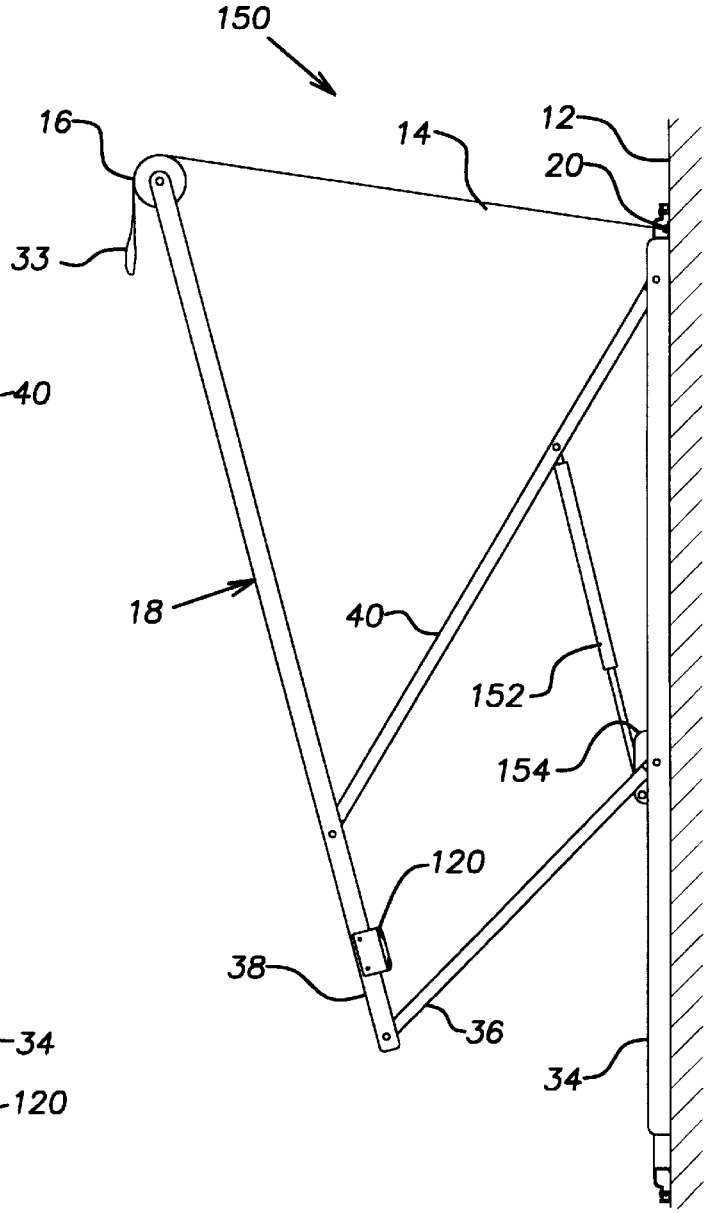
FIG. 12 is a side elevational view of the awning of FIG. 11 in a partially deployed or extended position.
Figure 13:
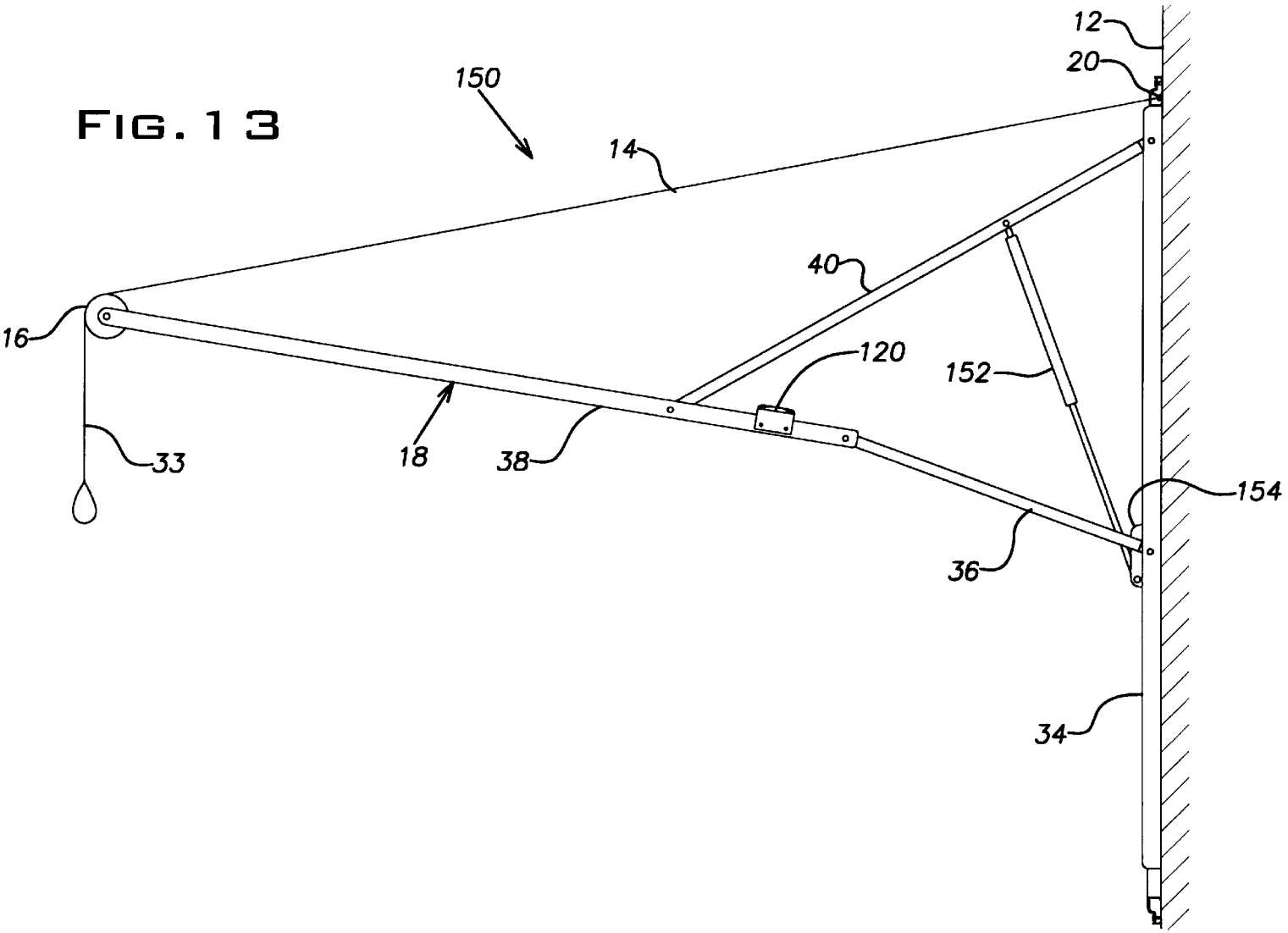
FIG. 13 is a side elevational view of the awning of FIGS. 11 and 12 in a fully deployed or extended position.

FIGS. 11 to 13 illustrate a second embodiment of a retractable awning 150 according to the present invention wherein like reference numbers are used for like structure. The awning 150 according to the second embodiment of the present invention is substantially the same as the awning 10 according to the first embodiment of the present invention except that the force producing member is a compression gas spring 152. A suitable gas spring is available from Suspa, Inc., Grand Rapids, Mich. The spring 152 illustrates that configurations with compression springs can be utilized and that other types of springs such as gas springs can be utilized.

Because the spring 152 is a compression spring, it is preferably mounted between the base arm 34 and the top arm 40. A first end of the spring 152 is mounted to the base arm 34 by a mounting bracket 154. The mounting bracket 154 is secured to the side wall 43 of the base arm 34 at an intermediate portion thereof by any suitable manner such as, for example, rivets or screws. In the illustrated embodiment, the lower mounting bracket 154 is secured at the pivot joint between the base arm 34 and the bottom arm 36. Each end of the spring 152 is preferably provided with a pivotable ball end joint. A second end of the spring 152 is mounted to the top arm 40 at a central or intermediate portion thereof by any suitable manner such as, for example, a threaded stud of a pivotable ball end joint. The side wall 43 of the base arm 34 is preferably provided with a suitable cut out or clearance opening for the end joint when in the retracted position.

In the illustrated awning 150, the spring 152 is mounted with the cylinder portion secured to the top arm 40 and the rod portion secured to the base arm 34. It is noted, however, that the spring can alternatively be mounted in the reverse orientation, that is, with the rod portion secured to the top arm 40 and the Cylinder portion secured to the base arm 34. This reverse orientation may be particularly advantageous when the awning 150 is secured to a recreational vehicle to protect against road splash.

Figure 14:
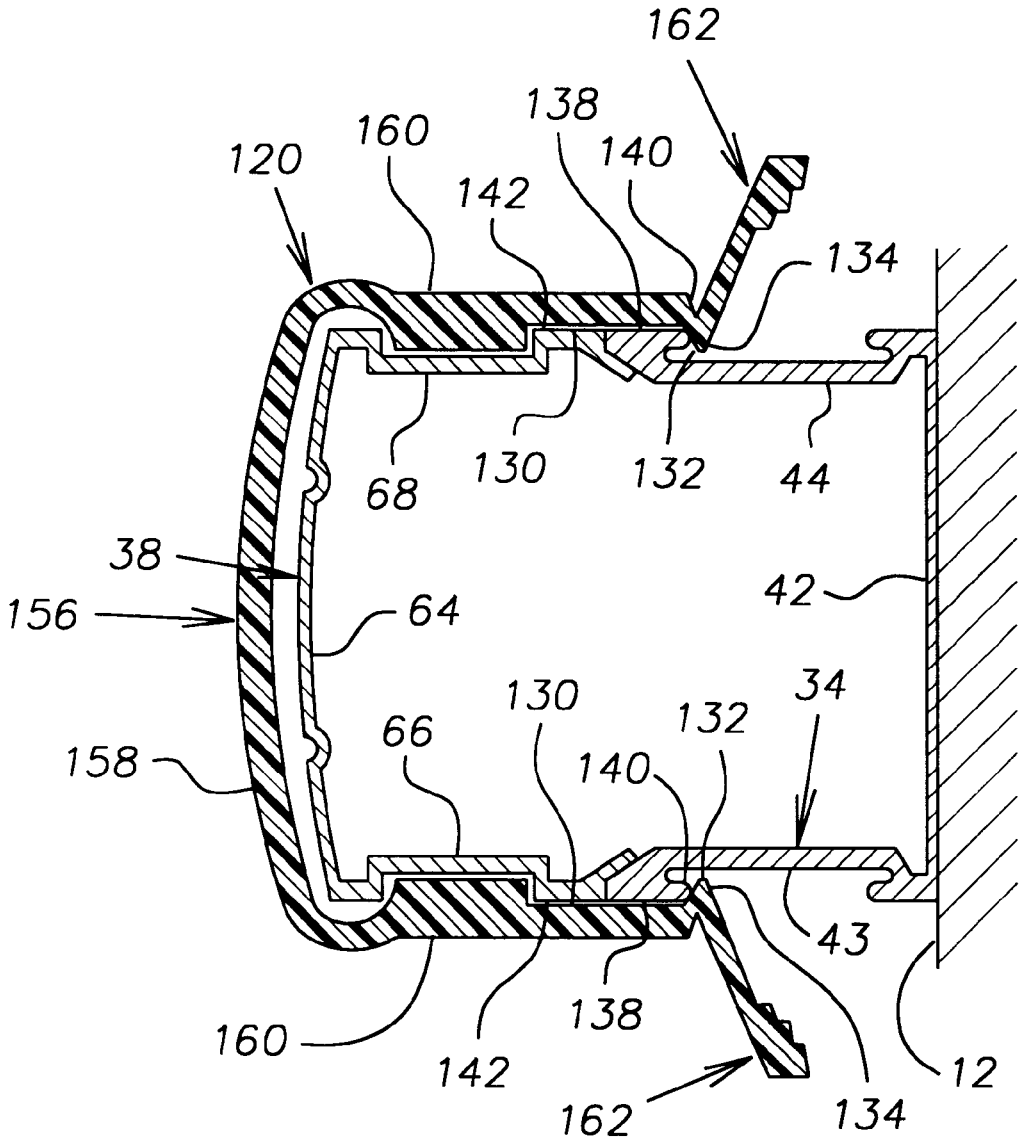
FIG. 14 is a cross-sectional view similar to FIG. 1B but showing a second embodiment of the travel latch.

FIG. 14 illustrates a second embodiment of the latch 120 wherein the latch 120 is resiliently secured to the extended arm 38 using spring tension rather than rigidly secured with mechanical fasteners 128 (FIG. 7), The latch 120 has a main portion 156 which is generally U-shaped and extends around the forward side of the extended arm 38 so that it resiliently grips the arm 38 with spring tension. The main portion 156 includes a connector 158 extending across the main wall 64 of the extended arm 38 and a pair of legs 160 rearwardly extending from the ends of the connector 158. The legs 160 rearwardly extend along the side walls 66, 68 of the extended arm 38. Preferably, the legs 160 are substantially the same as the first embodiment of the latch such as, for example having the engagement ramp 132 and the angled surface 134. Each end of the main portion 156 has a handle portion 162 which laterally extends outward from a free end of the legs 160.

It is noted that the travel latch 120 can be secured to the extended arm in other suitable manners such as, for example, the travel latch 120 can be shaped to extend around the extended arm 38 such that it resiliently grips the arm 38.

Although particular embodiments of the invention have been described in detail, it will be understood that the invention is not limited correspondingly in scope, but includes all changes and modifications coming within the spirit and terms of the claims appended hereto.

What is claimed is:

1. A retractable awning for mounting to a wall, said awning comprising:

a roller;

a flexible canopy having an inner edge for connection to the wall and an outer edge secured to said roller;

a pair of arm assemblies supporting opposite ends of said roller and operable to move said roller between a retracted position adjacent the wall and an extended position spaced from the wall, each of said arm assemblies including a vertically extending base arm for connection to the wall, a bottom arm having a first end pivotally connected to said base arm, an extended arm having a first end pivotally connected to said bottom arm and a second end connected to and supporting said roller, and a top arm having a first end pivotally connected to said base arm and a second end pivotally connected to said extended arm; and a latch secured to one of said extended arms and adapted to engage the associated base arm to releasably secure said extended arm to said base arm when in the retracted position.

2. The retractable awning according to claim 1, wherein each of said arm assemblies further includes a force producing member for outwardly biasing said arm assembly toward the extended position.

3. The retractable awning according to claim 2, wherein said roller includes a torsion spring biasing said roller toward the retracted position.

4. The retractable awning according to claim 1, wherein said latch is rigidly secured to said extended arm with a mechanical fastener.

5. The retractable awning according to claim 4, wherein said spring tension is created by deflection of said extended arm and said latch.

6. The retractable awning according to claim 1, wherein said latch is resiliently secured to said extended arm.

7. The retractable awning according to claim 1, wherein said base arm has a lip and said latch has an angled ramp adapted for engaging said lip.

8. The retractable awning according to claim 7, wherein said ramp has an angle of about 15 to about 30 degrees.

9. The retractable awning according to claim 8, wherein said ramp has an angle of about 20 degrees.

10. The retractable awning according to claim 1, wherein said latch comprises a polymer.

11. The retractable awning according to claim 1, wherein said latch has a main wall and an handle portion extending from said main wall, said main wall being secured to said extended arm.

12. The retractable awning according to claim 1, wherein said base arm and said extended arm each have a main wall and a pair of side walls extending from opposite edges of said main wall to form a channel, said channels of said base arm and said extended arm facing each other in the retracted position.

13. The retractable awning according to claim 12, wherein said latch is secured to one of said side walls of said extended arm and engages one of said side walls of said base arm, and said latch releasably secures said extended arm to said base arm using spring tension created by deflection of said extended arm and said latch.

14. A retractable awning for mounting to a wall, said awning comprising:

a roller;

a flexible canopy having an inner edge for connection to the wall and an outer edge secured to said roller;

a pair of arm assemblies supporting opposite ends of said roller and operable to move said roller between a retracted position adjacent the wall and an extended position spaced from the wall, each of said arm assemblies including a vertically extending base arm for connection to the wall, an extended arm operatively connected to said base arm and having an upper end connected to and supporting said roller, said extended arm having a main wall and a pair of side walls extending from opposite edges of said main wall to form a channel, said channel facing said base arm when in the retracted position; and a spring-biased latch rigidly secured to an associated one of said side walls of said extended arm and adapted to engage said base arm to releasably secure said extended arm to said base arm when in the retracted position.

15. The retractable awning according to claim 14, wherein each of said arm assemblies further includes a force producing member extending between said base arm and one of said bottom arm and said top arm for outwardly pivoting said bottom arm, said extended arm, and said top arm toward the extended position.

16. The retractable awning according to claim 14, wherein said base arm has a lip and said latch has an angled ramp adapted for engaging said lip.

17. The retractable awning according to claim 16, wherein said ramp has an angle of about 15 to about 30 degrees.

18. The retractable awning according to claim 14, wherein said latch comprises a polymer.

19. The retractable awning according to claim 14, wherein said base arm has a main wall and a pair of side walls extending from opposite edges of said main wall to form a channel, said channels of said base arm and said extended arm facing each other when in the retracted position.

20. The retractable awning according to claim 14, wherein each of said arm assemblies further includes a bottom arm and a top arm, said bottom arm has a first end pivotally connected to said base arm and a second end pivotally connected to said extended arm, and said top arm has a first end pivotally connected to said base arm above said bottom arm and a second end pivotally connected to said extended arm.

21. A retractable awning for mounting to a wall, said awning comprising:

a roller;

a flexible canopy having an inner edge for connection to the wall and an outer edge secured to said roller;

a pair of arm assemblies supporting opposite ends of said roller and operable to move said roller between a retracted position adjacent the wall and an extended position spaced from the wall, each of said arm assemblies including a vertically extending base arm for connection to the wall, an extended arm operatively connected to said base arm and having an upper end connected to and supporting said roller, said extended arm having a main wall and a pair of side walls extending from opposite edges of said main wall to form a channel, said channel facing said base arm when in the retracted position; and a spring-biased latch resiliently secured to an associated one of said extended arms and adapted to engage said base arm to releasably secure said extended arm to said base arm when in the retracted position.

22. The retractable awning according to claim 21, wherein each of said arm assemblies further includes a force producing member extending between said base arm and one of said bottom arm and said top arm for outwardly pivoting said bottom arm, said extended arm, and said top arm toward the extended position.

23. The retractable awning according to claim 21, wherein said base arm has a lip and said latch has an angled ramp adapted for engaging said lip.

24. The retractable awning according to claim 23, wherein said ramp has an angle of about 15 to about 30 degrees.

25. The retractable awning according to claim 21, wherein said latch comprises a polymer.

26. The retractable awning according to claim 21, wherein said base arm has a main wall and a pair of side walls extending from opposite edges of said main wall to form a channel, said channels of said base arm and said extended arm facing each other when in the retracted position.

27. The retractable awning according to claim 21, wherein each of said arm assemblies further includes a bottom arm and a top arm, said bottom arm has a first end pivotally connected to said base arm and a second end pivotally connected to said extended arm, and said top arm has a first end pivotally connected to said base arm above said bottom arm and a second end pivotally connected to said extended arm.

28. A retractable awning for mounting to a wall, said awning comprising:

a roller assembly;

a flexible canopy having an inner edge for connection to the wall and an outer edge secured to said roller assembly;

a pair of arm assemblies supporting opposite ends of said roller assembly and operable to move said roller assembly between a retracted position adjacent the wall and an extended position spaced from the wall, each of said arm assemblies including a vertically extending base arm for connection to the wall, a bottom arm having a first end pivotally connected to said base arm, an extended arm having a first end pivotally connected to said bottom arm and a second end connected to and supporting said roller assembly, and a top arm having a first end pivotally connected to said base arm above said bottom arm and a second end pivotally connected to said extended arm, said base arm and said extended arm each having a main wall and a pair of side walls extending from opposite edges of said main wall to form a channel, said channels of said base arm and said extended arm facing each other in the retracted position, at least one of said side walls of said base arm having a lip; and a latch comprised of a polymer and rigidly secured to an associated one of said side walls of said extended arm, said latch having an angled ramp adapted for engaging said lip to releasably secure said extended arm to said base arm when in the retracted position.

* * * * *